US007545345B2

(12) United States Patent
Kim et al.

(10) Patent No.: US 7,545,345 B2
(45) Date of Patent: Jun. 9, 2009

(54) PLASMA DISPLAY PANEL AND DRIVING METHOD THEREOF

(75) Inventors: Jin-Sung Kim, Suwon-si (KR); Seung-Hun Chae, Suwon-si (KR); Jin-Ho Yang, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 768 days.

(21) Appl. No.: 11/129,757

(22) Filed: May 13, 2005

(65) Prior Publication Data

US 2005/0280024 A1 Dec. 22, 2005

(30) Foreign Application Priority Data

May 20, 2004 (KR) ..... 10-2004-0035920

(51) Int. Cl.
*G09G 3/28* (2006.01)

(52) U.S. Cl. ..... 345/60; 345/37; 345/41; 345/61; 345/62; 345/63; 345/64; 345/65; 345/66; 345/67; 345/68; 315/169.4

(58) Field of Classification Search ..... 345/37, 345/41, 42, 55–72; 315/169.4
See application file for complete search history.

(56) References Cited

U.S. PATENT DOCUMENTS

| | | | | |
|---|---|---|---|---|
| 6,356,261 | B1 * | 3/2002 | Kim | 345/209 |
| 7,242,373 | B2 * | 7/2007 | Tomio et al. | 345/60 |
| 7,271,800 | B2 * | 9/2007 | Choi et al. | 345/204 |
| 7,375,702 | B2 * | 5/2008 | Yokoyama et al. | 345/37 |
| 2003/0030599 | A1 * | 2/2003 | Kim | 345/60 |
| 2004/0085262 | A1 | 5/2004 | Lee | |

FOREIGN PATENT DOCUMENTS

| | | |
|---|---|---|
| CN | 1355518 A | 6/2002 |
| CN | 1389841 A | 1/2003 |
| CN | 1409284 A | 4/2003 |
| JP | 8-320668 | 12/1996 |
| JP | 11-65516 | 3/1999 |

(Continued)

OTHER PUBLICATIONS

Patent Abstracts of Japan for Publication No. 08-320668; dated Dec. 3, 1996 in the name of Toshihiro Yoshioka.

(Continued)

*Primary Examiner*—Sumati Lefkowitz
*Assistant Examiner*—Viet Pham
(74) *Attorney, Agent, or Firm*—Christie, Parker & Hale, LLP

(57) ABSTRACT

A plasma display panel and a driving method thereof. In the plasma display panel, Y electrodes are divided into a plurality of groups according to a scanning order and a final reset voltage is established to be different for each group. The plasma display panel includes a panel including a plurality of first electrodes and second electrodes, a plurality of selection circuits that are respectively coupled to the plurality of the first electrodes, and a driving circuit coupled to the second terminals of the selection circuits. The driving circuit includes a transistor which allows the voltage at the first electrodes to be reduced in a ramp style in a reset period.

20 Claims, 10 Drawing Sheets

FOREIGN PATENT DOCUMENTS

| | | |
|---|---|---|
| JP | 11-242460 | 9/1999 |
| JP | 2000-132140 | 5/2000 |
| JP | 2000-276106 | 10/2000 |
| JP | 2001-13911 | 1/2001 |
| JP | 2001-13912 | 1/2001 |
| JP | 2001-184023 | 7/2001 |
| JP | 2002-215089 | 7/2002 |
| JP | 2002-258794 | 9/2002 |
| JP | 2002-278510 | 9/2002 |
| JP | 2002-351395 | 12/2002 |
| JP | 2002-366084 | 12/2002 |
| JP | 2003-15602 | 1/2003 |
| JP | 2004-29185 | 1/2004 |
| JP | 2004-302115 | 10/2004 |

OTHER PUBLICATIONS

Patent Abstracts of Japan for Publication No. 11-65516; dated Mar. 9, 1999 in the name of Takeo Masuda, et al.
Patent Abstracts of Japan for Publication No. 11-242460; dated Sep. 7, 1999 in the name of Tsutomu Tokunaga, et al.
Patent Abstracts of Japan for Publication No. 2001-013912; dated Jan. 19, 2001 in the name of Kenji Awamoto, et al.
Patent Abstracts of Japan for Publication No. 2001-013911; dated Jan. 19, 2001 in the name of Kunio Takayama, et al.
Patent Abstracts of Japan for Publication No. 2001-184023; dated Jul. 6, 2001 in the name of Shunichi Wakabayashi, et al.
Patent Abstracts of Japan for Publication No. 2002-215089; dated Jul. 31, 2002 in the name of Shigetoshi Tomio, et al.
Patent Abstracts of Japan for Publication No. 2002-258794; dated Sep. 11, 2002 in the name of Yoshito Tanaka, et al.
Patent Abstracts of Japan for Publication No. 2002-278510; dated Sep. 27, 2002 in the name of Kunio Takayama.
Patent Abstracts of Japan for Publication No. 2002-351395; dated Dec. 6, 2002 in the name of Katsutoshi Shindo, et al.
Patent Abstracts of Japan for Publication No. 2002-366084; dated Dec. 20, 2002 in the name of Shuichi Yamanaka.
Patent Abstracts of Japan for Publication No. 2003-015602; dated Jan. 17, 2003 in the name of Kenji Awamoto, et al.
Patent Abstracts of Japan for Publication No. 2004-029185; dated Jan. 29, 2004 in the name of Minoru Takeda.
Patent Abstracts of Japan for Publication No. 2004-302115; dated Oct. 28, 2004 in the name of Hitoshi Hirakawa, et al.

* cited by examiner

PLASMA DISPLAY PANEL AND DRIVING METHOD THEREOF

CROSS REFERENCE TO RELATED APPLICATION

This application claims priority to and the benefit of Korean Patent Application No. 10-2004-0035920 filed on May 20, 2004 in the Korean Intellectual Property Office, the entire content of which is incorporated herein by reference.

BACKGROUND OF THE INVENTION

1. Field of the Invention

The present invention relates to a plasma display panel (PDP) and a driving method thereof.

2. Discussion of the Related Art

The PDP is in the spotlight as a display device having many desirable characteristics because it has higher resolution, a higher rate of emission efficiency, and a wider view angle in comparison to other flat panel displays.

The PDP is a flat panel display for showing characters or images using plasma generated by gas discharge, and includes more than hundreds of thousands to millions of pixels arranged in a matrix format, in which the number of pixels are determined by the size of the PDP. A configuration of the PDP will now be described with reference to FIG. 1 and FIG. 2.

FIG. 1 shows a partial perspective view of the PDP, and FIG. 2 shows an electrode arrangement of the PDP.

As shown in FIG. 1, the PDP has two glass substrates 1 and 6 that face each other with a gap therebetween. Scan electrodes 4 and sustain electrodes 5 in pairs are formed in parallel on the first glass substrate 1, and the scan electrodes 4 and the sustain electrodes 5 are covered with a dielectric layer 2 and a protection film 3. A plurality of address electrodes 8 are formed on the second glass substrate 6, and the address electrodes 8 are covered with an insulator layer 7. Barrier ribs 9 are formed in parallel with the address electrodes 8 on the insulator layer 7 between the address electrodes 8, and phosphors 10 are formed on the surface of the insulator layer 7 and on both sides of the barrier ribs 9. The glass substrates 1 and 6 are provided facing each other with discharge spaces 11 between the glass substrates 1 and 6 so that the scan electrodes 4 and the sustain electrodes 5 can cross the address electrodes 8. A discharge space 11 between the address electrode 8 and a crossing part of a pair of the scan electrode 4 and the sustain electrode 5 forms a discharge cell 12.

As shown in FIG. 2, the electrodes of the PDP have an m×n matrix format. The address electrodes A1 to Am are arranged in the column direction, and n scan electrodes Y1 to Yn and sustain electrodes X1 to Xn are arranged in the row direction.

Conventionally, a frame is divided into a plurality of subfields in order to operate the PDP, and gray scales are represented by a combination of the subfields. Each of the subfields includes a reset period, an address period, and a sustain period.

In the reset period, wall charges formed by previous sustain-discharging are eliminated, and the wall charges are established in order to perform the next address-discharging stably. In the address period, cells that are turned on and the cells that are turned off on the panel are selected, and the wall charges are accumulated to the cells that are turned on (i.e., addressed cells). In the sustain period, a discharge for substantially displaying images on the addressed cells is performed.

The term "wall charges" as used herein refers to charges that are formed on a wall of discharge cells neighboring each electrode and accumulated to electrodes. Although the wall charges do not actually touch the electrodes, it will be described that the wall charges are "generated", "formed", or "accumulated" thereon. Also, a wall voltage represents a potential difference formed on the wall of the discharge cells by the wall charges.

FIG. 3 shows a conventional PDP driving waveform diagram.

As shown in FIG. 3, a voltage at the scan electrode (i.e., Y electrode) is reduced to a voltage of VscL while a wall voltage between the scan electrode and the sustain electrode is maintained at a voltage which approximates a discharge firing voltage when the reset period is about to end. In the address period, a scan pulse which has the voltage of VscL as a low peak voltage and a voltage of VscH as a high peak voltage is applied to the scan electrode in sequence, and at the same time a data pulse is applied to the address electrode so as to generate an address discharge.

The address discharge is determined by the density of priming particles and the wall voltage generated in the discharge space. For the scan electrodes on the upper part of the panel, the address discharge is easily generated because the address discharge is generated only a short time after the reset period is finished, and therefore erroneous discharge may be generated when an excessive wall voltage is generated. On the contrary, in the scan electrodes on the lower part of the panel, it takes longer to apply the scan pulse after the reset discharge is generated, and therefore a voltage in the discharge space is gradually reduced because the density of the priming particles is reduced and the wall voltage is eliminated little by little. Accordingly, it takes longer to be discharged on the lower part of the panel than on the upper part of the panel and an address margin is problematically reduced.

SUMMARY OF THE INVENTION

In an exemplary embodiment of the present invention, a driving apparatus of a plasma display panel for preventing an erroneous discharge and increasing a discharge margin in an address period, is provided.

Additional features of the invention will be set forth in the description which follows, and in part will be apparent from the description, or may be learned by practice of the invention.

In an exemplary embodiment of the present invention, a method for driving a plasma display panel including a plurality of first electrodes and a plurality of second electrodes, is provided.

According to the method, the first electrodes are divided into a plurality of groups that include a first group and a second group.

In a reset period, a) a voltage at the first electrodes is gradually reduced to a first voltage, b) a second voltage, which is greater than the first voltage, is applied to the first electrodes of the first group, c) the voltages at the first electrodes of the groups except for the first group are gradually reduced to a third voltage, which is less than the first voltage, and d) a fourth voltage, which is greater than the third voltage, is applied to the first electrodes of the second group.

In an address period, scan pulses may be sequentially applied to the first electrodes of the first group while the voltage at the first electrodes of the first group is maintained at the second voltage, and the scan pulses may be sequentially applied to the first electrodes of the second group while the voltage at the first electrodes of the second group is maintained at the fourth voltage.

The fourth voltage may substantially be the same as the second voltage.

The plurality of groups may further include a third group. After d) in the reset period, e) the voltage at the first electrodes of the groups except for the first and second groups may be gradually reduced to a fifth voltage, which is less than the third voltage, and f) a sixth voltage, which is greater than the fifth voltage, may be applied to the first electrodes of the third group.

The voltage at the first electrodes may be reduced in a ramp style. The voltage at the first electrodes may be gradually reduced by repeatedly reducing the voltage at the first electrodes by a predetermined amount and floating the first electrodes.

In another exemplary embodiment according to the present invention, a method for driving a plasma display panel including a plurality of first electrodes and a plurality of second electrodes, is provided.

According to the method, in a reset period, a voltage at the first electrodes is gradually reduced, a non-scan voltage is applied to the first electrodes of a first group among the plurality of first electrodes while the voltage at the first electrodes except for the first electrodes of the first group is reduced, and the non-scan voltage is applied to the first electrodes of a second group among the plurality of first electrodes after the voltage at the first electrodes of the second group is reduced to a final reset voltage.

In an address period, a scan voltage may be sequentially applied to the plurality of first electrodes.

In yet another exemplary embodiment according to the present invention, a plasma display panel is provided. The plasma display panel includes a panel including a plurality of first electrodes and a plurality of second electrodes, and a plurality of selection circuits that are respectively coupled to the plurality of first electrodes. Each selection circuit has a first terminal and a second terminal, and each selection circuit selectively applies a voltage supplied to the first terminal or a voltage supplied to the second terminal to a corresponding one of the first electrodes. The plasma display panel also includes a driving circuit coupled to the second terminals of the selection circuits. The driving circuit gradually reduces the voltage at the first electrodes in a reset period, and applies a scan voltage to the first electrodes through the second terminals of the selection circuits in an address period.

A non-scan voltage is applied to the first electrodes of a first group among the plurality of first electrodes through the first terminals of the selection circuits coupled to the first electrodes of the first group when the voltage at the first electrodes is reduced to a first voltage in the reset period.

The non-scan voltage is applied to the first electrodes of a second group among the plurality of first electrodes through the first terminals of the selection circuits coupled to the first electrodes of the second group when the voltage at the first electrodes of the second group is reduced to a second voltage, which is lower than the first voltage, in the reset period.

The driving circuit may include a transistor having a first terminal coupled to the second terminals of the selection circuits, and a second terminal coupled to a power source for supplying the scan voltage.

The transistor may allow the voltage at the first electrodes to be reduced in a ramp style in the reset period.

The driving circuit may further include a zener diode having a cathode coupled to the second terminal of the transistor and an anode coupled to the power source, and a switch coupled to the zener diode in parallel.

A breakdown voltage of the zener diode may be substantially the same as a difference between the first voltage and the second voltage.

The driving circuit may control the switch to be turned off to reduce the voltage at the first electrodes to the first voltage, and may control the switch to be turned off to reduce the voltage at the first electrodes to the second voltage.

The driving circuit may include a first transistor having a first terminal coupled to the second terminals of the selection circuits and a control terminal for receiving a control signal which alternately has a first level for turning on the first transistor and a second level which is an inverted level of the first level, a capacitor having a first terminal coupled to a second terminal of the first transistor and a second terminal coupled to a power source for supplying the scan voltage. The capacitor may receive charges from the first electrodes when the first transistor is turned on, and a discharge path for discharging the charges charged in the capacitor in response to the second level of the control signal.

The driving circuit may further include a second transistor which is coupled to the capacitor in parallel, and a zener diode having a cathode coupled to the second terminal of the capacitor and an anode coupled to the power source.

The driving circuit may control the second transistor to be turned off to reduce the voltage at the first electrodes to a voltage which is greater than the scan voltage by a breakdown voltage of the zener diode in the reset period, and may control the second transistor to be turned on to apply the scan voltage to the first electrodes.

BRIEF DESCRIPTION OF THE DRAWINGS

The accompanying drawings, together with the specification, illustrate exemplary embodiments of the present invention, and together with the description, serve to explain the principles of the present invention.

DETAILED DESCRIPTION

Figure 1:
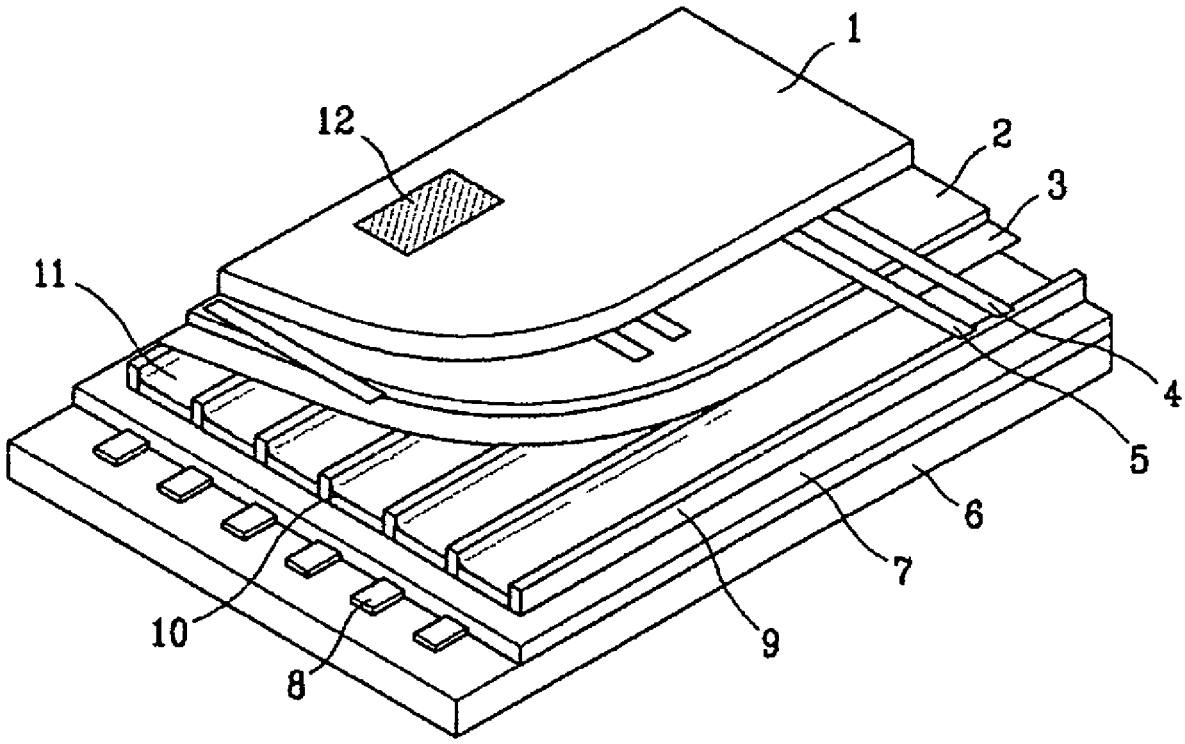
FIG. 1 (Prior Art)
FIG. 1 shows a partial perspective view of a plasma display panel (PDP).
Figure 2:
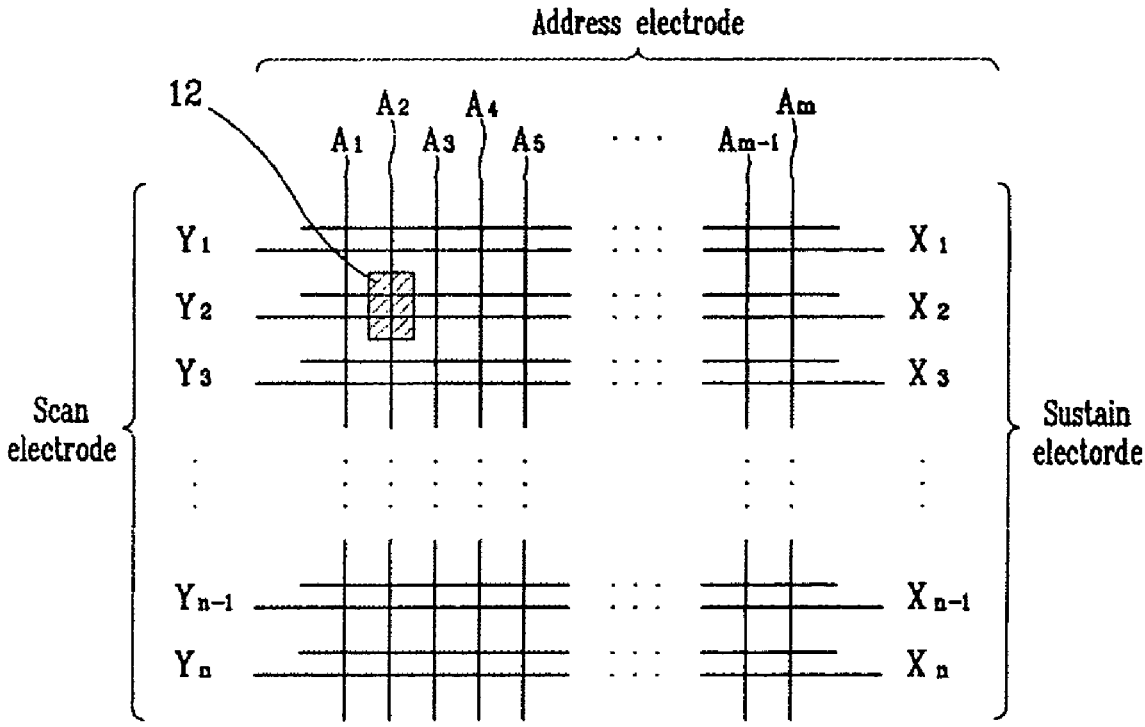
FIG.2(Prior Art )
FIG. 2 shows a diagram for representing an electrode arrangement of the PDP.
Figure 3:
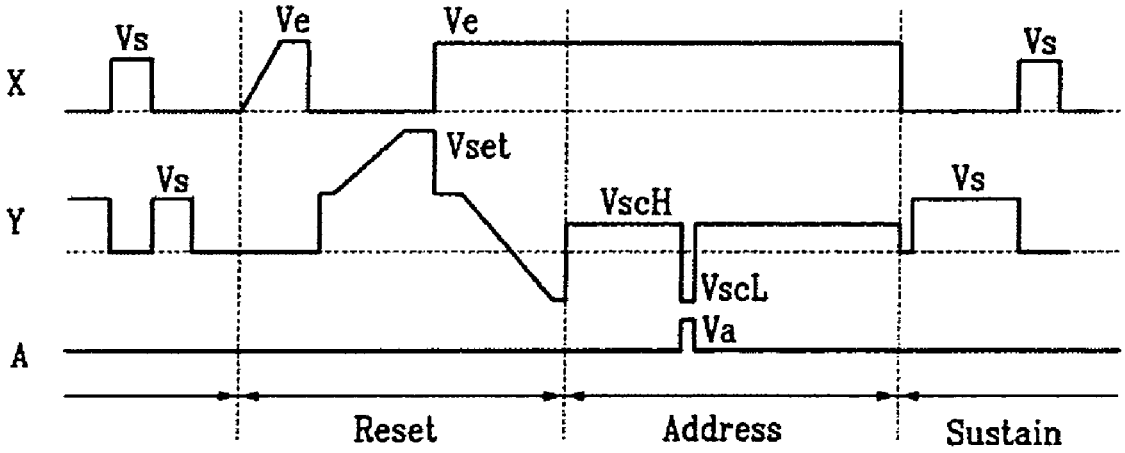
FIG.3(Prior Art )
FIG. 3 shows a conventional PDP driving waveform diagram.

In the following detailed description, exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, rather than restrictive.

There may be parts shown in the drawings, or parts not shown in the drawings, that are not discussed in the specification as they are not essential to a complete understanding of the invention. Further, like elements are designated by like reference numerals.

A plasma display panel according to exemplary embodiments of the present invention will now be described in detail with reference to FIG. 4.

Figure 4:
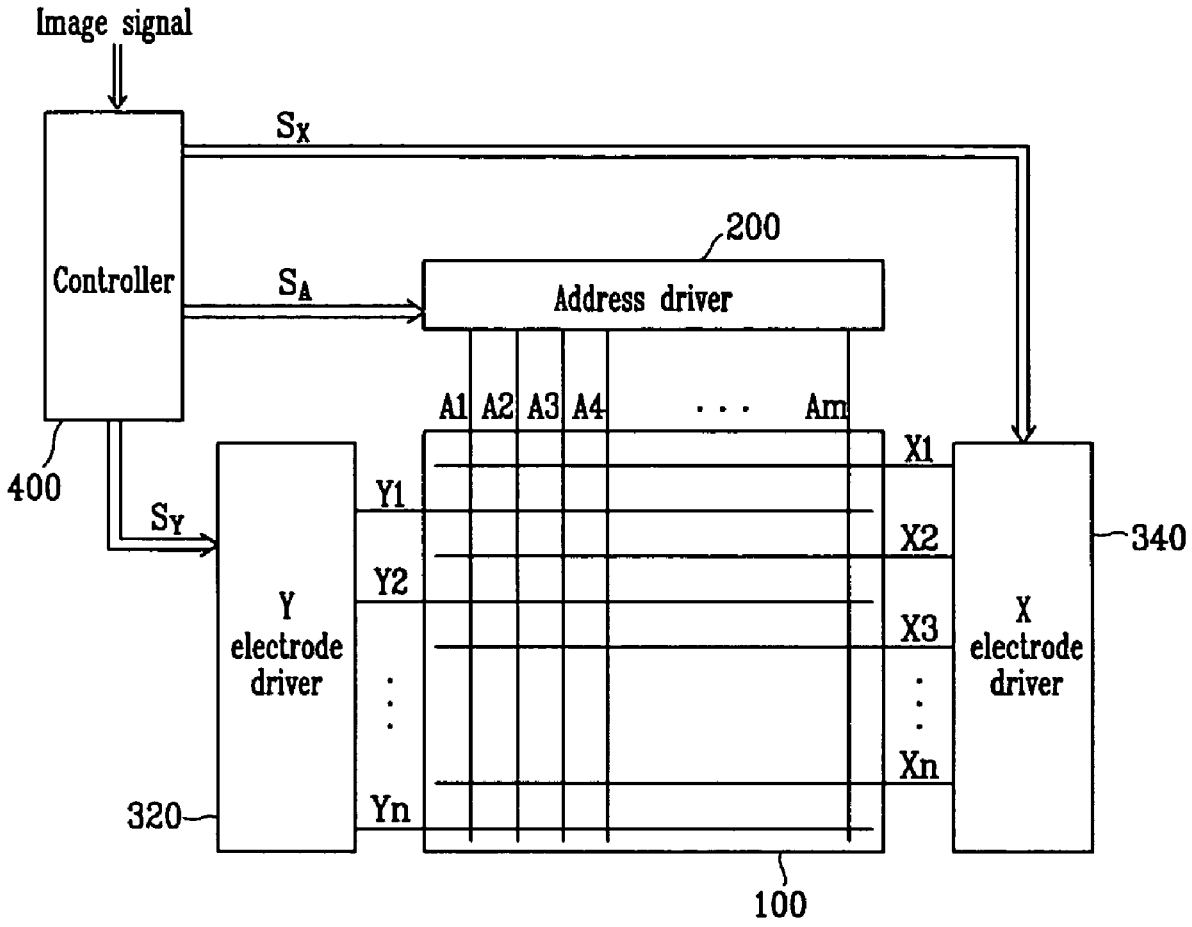
FIG. 4 is a block diagram of a PDP according to an exemplary embodiment of the present invention.

FIG. 4 is a block diagram of a PDP according to an exemplary embodiment of the present invention.

As shown in FIG. 4, the PDP according to the exemplary embodiment of the present invention includes a plasma panel 100, an address driver 200, a Y electrode driver 320, an X electrode driver 340, and a controller 400.

The plasma panel 100 includes a plurality of address electrodes A1 to Am arranged in the column direction, and first electrodes Y1 to Yn (hereinafter, referred to as Y electrodes) and second electrodes X1 to Xn (hereinafter, referred to as X electrodes) arranged alternately in the row direction.

The address driver 200 receives an address driving control signal $S_A$ from the controller 400 and applies a display data signal for selecting discharge cells to be displayed to each address electrode.

The Y electrode driver 320 and the X electrode driver 340 respectively receive a Y electrode driving signal $S_Y$ and an X electrode driving signal $S_X$ from the controller 400, and apply the signals to the X electrodes and the Y electrodes.

The controller 400 receives an external image signal, generates the address driving control signal $S_A$, the Y electrode driving signal $S_Y$, and the X electrode driving signal $S_X$, and respectively transmits them to the address driver 200, the Y electrode driver 320, and the X electrode driver 340.

Figure 5:
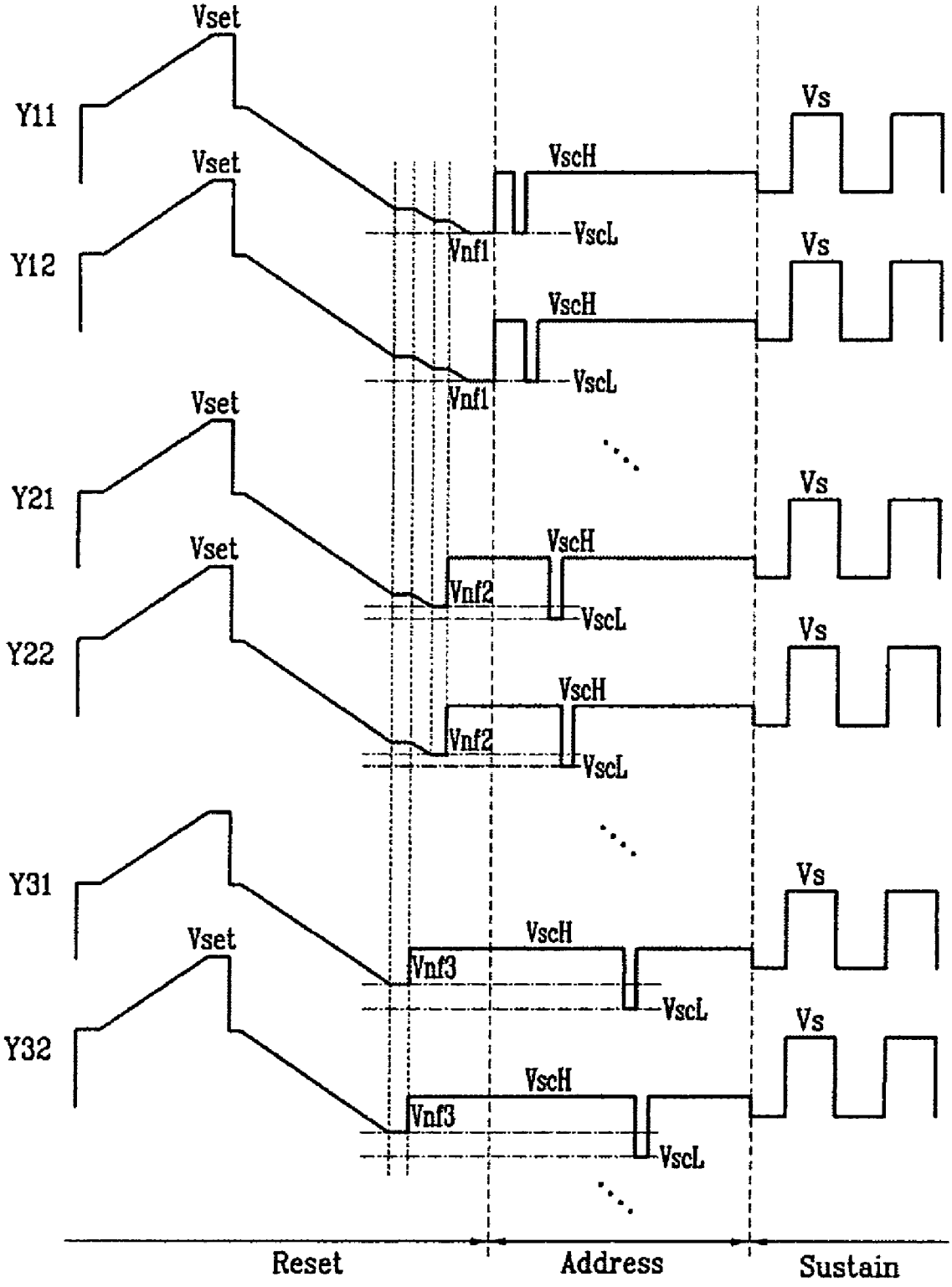
FIG. 5 shows a diagram for representing waveforms applied to the PDP according to the exemplary embodiment of the present invention.

FIG. 5 shows a diagram for representing waveforms applied to the Y electrodes of the PDP according to the exemplary embodiment of the present invention.

As shown in FIG. 5, according to the exemplary embodiment of the present invention, the Y electrodes are divided into a plurality of groups according to an order for scanning the Y electrodes, and final falling reset voltages are established to be different for different groups of Y electrodes when scan voltages are applied to the Y electrodes in sequence.

This is because the scan group which is addressed in an earlier address period is relatively easier to be discharged than the scan group which is addressed in a latter address period. Discharge is stably generated when less wall voltage is generated because the erroneous discharge may be generated when an excessive wall voltage is generated. Therefore, the final falling reset voltage for the scan group addressed in the earlier address period is established to be less for the purpose of eliminating a large amount of wall charges.

On the contrary, the scan group which is addressed in the latter address period has a longer time between the reset period and when they are addressed, and therefore the voltage in the discharge space is reduced because the density of the priming particles is reduced and the wall voltage is eliminated little by little. Accordingly, the final falling reset voltage for the scan group addressed in the latter address period is established to be high for the purpose of eliminating a less amount of wall charges.

FIG. 5 shows that the Y electrodes are divided into three groups (first, second, and third scan groups) in the scanning direction when the Y electrodes are sequentially scanned.

As shown in FIG. 5, a final falling reset voltage Vnf1 is established to correspond to a low peak voltage of a scan pulse VscL in a first scan group (Y11, Y12, . . . ) arranged on an upper part of the panel. A final falling reset voltage Vnf2 is established to be higher than the low peak voltage of the scan pulse VscL in a second scan group (Y21, Y22, . . . ) arranged on a middle part of the panel. A final falling reset voltage Vnf3 is established to be higher than the voltage of Vnf2 in a third scan group (Y31, Y32, . . . ) arranged on a lower part of the panel. As described, when the Y electrodes are divided into N number of scan groups, the final falling reset voltage Vnf is gradually increased as it proceeds from a first scan group to an $N^{th}$ scan group, and therefore the amount of eliminated wall charges in the reset period is reduced.

Figure 6:
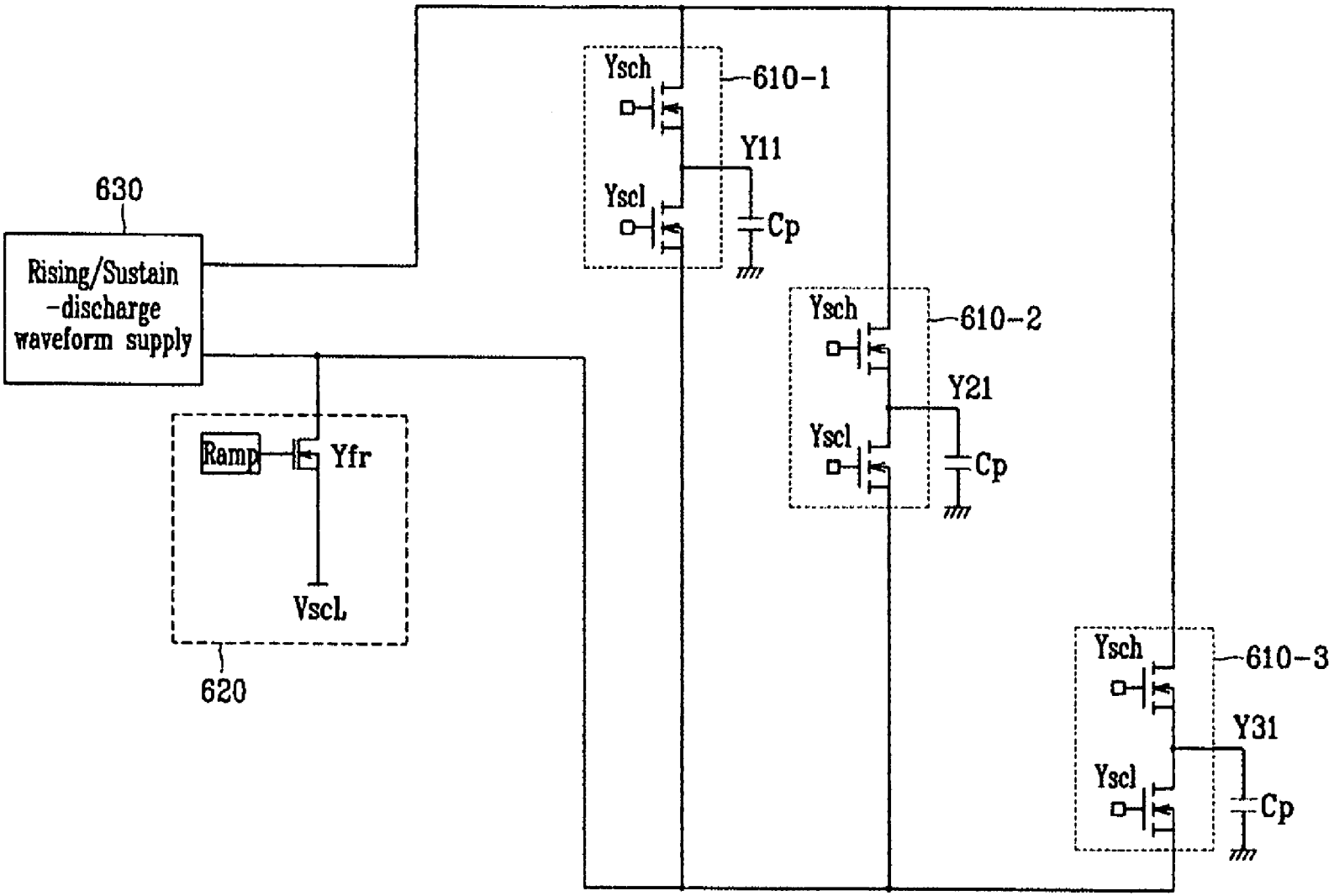
FIG. 6 is a schematic diagram of a Y electrode driver according to a first exemplary embodiment of the present invention.
Figure 7:
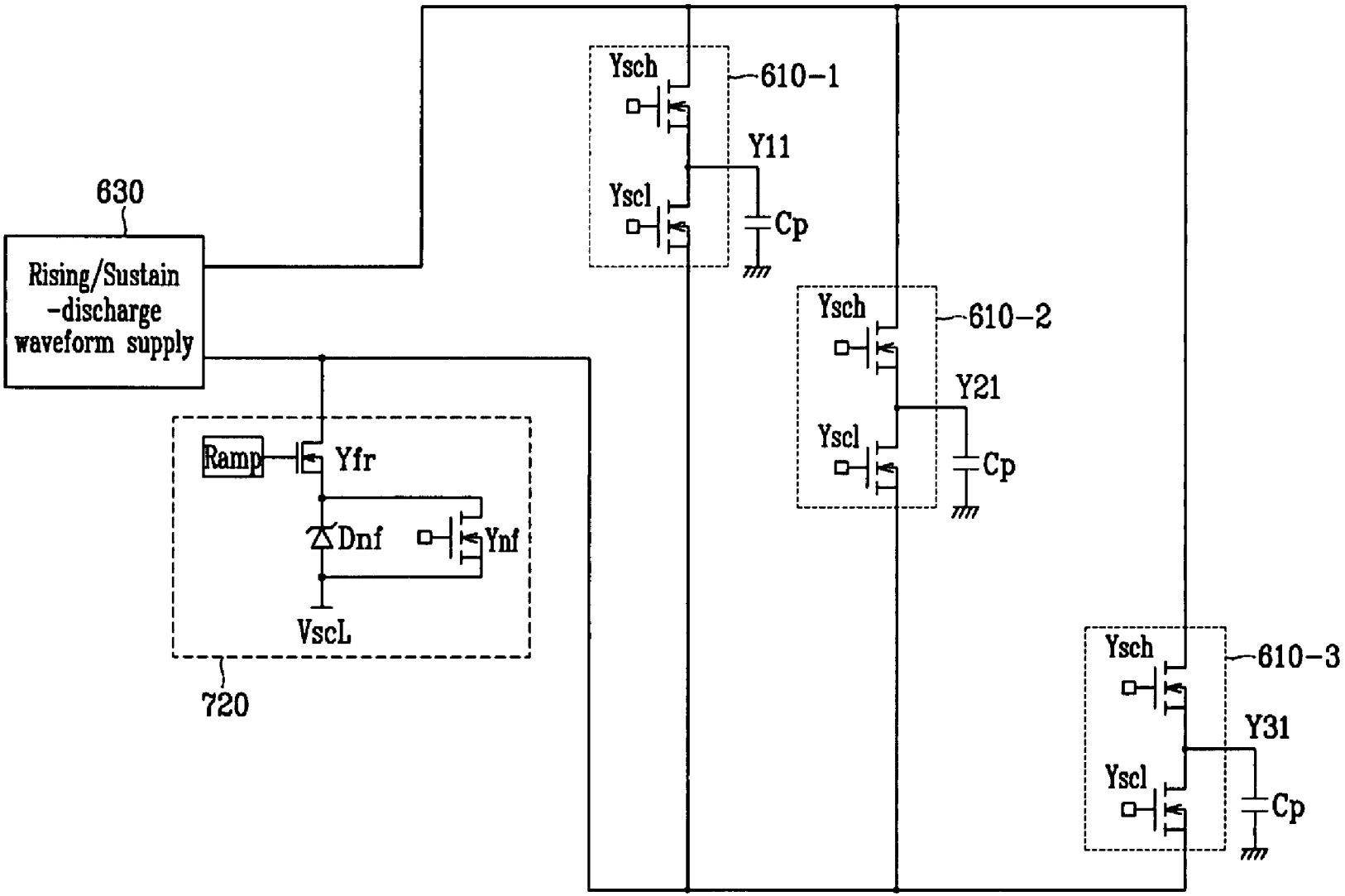
FIG. 7 is a schematic diagram of a Y electrode driver according to a second exemplary embodiment of the present invention.
Figure 8:
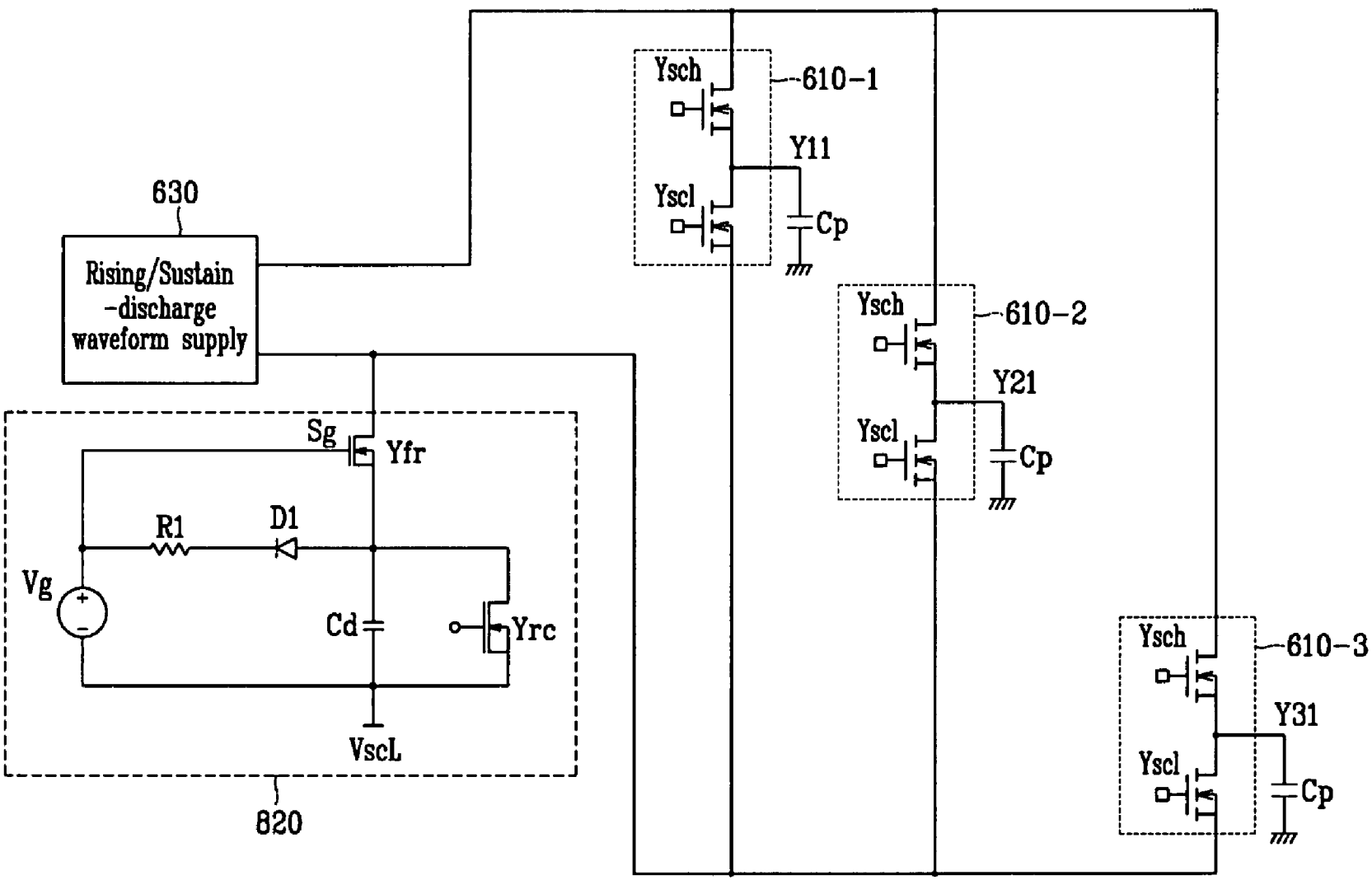
FIG. 8 is a schematic diagram of a Y electrode driver according to a third exemplary embodiment of the present invention.

FIGS. 6 to 8 are schematic diagrams of Y electrode drivers according to first to third exemplary embodiments of the present invention. In FIGS. 6 to 8, it is assumed that the final falling reset voltage Vnf1 corresponds to the low peak voltage of the scan pulse VscL.

In the Y electrode driver, selection circuits 610 (i.e., 610-1, 610-2, 610-3) are coupled to the respective Y electrodes so as to sequentially select the Y electrodes in the address period. The selection circuits 610, for example, may be implemented on an integrated circuit (IC). In FIGS. 6 to 8 and FIG. 10, for convenience of description, one Y electrode from each of the first to third scan groups (Y11, Y21, and Y31) and selection circuits (610-1, 610-2, and 610-3) coupled to the respective Y electrodes are illustrated. Further, a capacitive load formed by the X electrodes neighboring to the Y electrodes is represented as Cp, which may also be referred to hereinafter as a panel capacitor. A sustain electrode driving circuit (not illustrated) is coupled to the Y electrode and represented as a ground for convenience.

As shown in FIG. 6, the Y electrode driver according to the first exemplary embodiment of the present invention includes the selection circuits 610-1, 610-2 and 610-3, a falling waveform supply 620, and a rising/sustain-discharge waveform supply 630.

Each of the selection circuits 610-1, 610-2, 610-3 includes two transistors Ysch and Yscl. A body diode is formed from a source to a drain in the respective transistors Ysch and Yscl. A source of the transistor Ysch and a drain of the transistor Yscl are coupled through a corresponding one of the Y electrodes Y11, Y21, and Y31 to the respective panel capacitor Cp. Also, the rising/sustain-discharge waveform supply 630 is coupled between a drain of the transistor Ysch and a source of the transistor Yscl, and the falling waveform supply 620 is coupled to the source of the transistor Yscl.

The rising/sustain-discharge waveform supply 630 supplies a rising waveform to the Y electrodes for a rising reset period, and circuits for supplying a general type of rising voltage may be used for the rising/sustain-discharge waveform supply as those skilled in the art would appreciate. Also, the supply 630 supplies a sustain-discharge waveform to the Y electrodes for a sustain period.

The falling waveform supply 620 includes a transistor Yfr for supplying a ramp waveform to the Y electrode in a falling reset period. While the transistors Ysch, Yscl, and Yfr are illustrated as N-channel field effect transistors in FIG. 6, various different switches that can perform a function similar to that of the transistor Yfr may be used instead of the transistor Yfr. A drain which is a main terminal of the transistor Yfr is coupled to the rising/sustain waveform supply 630, and a source which is another main terminal is coupled to a power source for supplying the voltage VscL.

A method for supplying the falling waveform to each scan group for the falling reset period by the Y electrode driver according to the first exemplary embodiment of the present invention will now be described.

The transistor Yfr is turned on and voltages of the Y electrodes Y11, Y21, and Y31 are gradually reduced to a final reset voltage Vnf3 of the third scan group. At this time, the transistors Yscl of the respective selection circuits 610-1, 610-2, and 610-3 are turned on. When the voltages of the Y electrodes Y11, Y21, and Y31 are reduced to the voltage of Vnf3, the transistor Yfr is turned off and a voltage at the Y electrodes is floated. After a predetermined time, the transistor Yscl of the selection circuit 610-3 coupled to the Y electrode Y31 of the third scan group is turned off and the transistor Ysch of the selection circuit 610-3 coupled to the Y electrode Y31 of the third scan group is turned on, and the transistor Yfr is turned on. The high peak voltage VscH of the scan pulse is applied to the Y electrode Y31 coupled to the selection circuit 610-3 through the transistor Ysch as shown in FIG. 5. At this time, the voltages of the Y electrodes Y11 and Y21 are gradually reduced from the voltage of Vnf3 because the transistors Yscl of the selection circuits 610-1 and 610-2 coupled to the Y electrodes Y11 and Y21 of the first and second scan groups are maintained to be turned on. Also, the transistor Ysch of the selection circuit 610-3 coupled to the Y electrode Y31 of the third scan group is maintained to be turned on, and therefore the voltage at the Y electrode Y31 is maintained at the voltage of VscH.

When the voltages of the Y electrodes Y11 and Y21 are gradually reduced from the voltage of Vnf3 and reach the final reset voltage Vnf2 of the second scan group, the transistor Yfr is turned off and the voltages of the Y electrodes Y11 and Y21 are floated. After a predetermined time, the transistor Yscl of the selection circuit 610-2 coupled to the Y electrode Y21 of the second scan group is turned off and the transistor Ysch of the selection circuit 610-2 coupled to the Y electrode Y21 of the second scan group is turned on, and the transistor Yfr is turned on. The high peak voltage VscH of the scan pulse is applied to the Y electrode Y21 coupled to the selection circuit 610-2 through the transistor Ysch as shown in FIG. 5. At this time, the voltage at the Y electrodes Y11 is gradually reduced from the voltage of Vnf2 because the transistor Yscl of the selection circuit 610-1 coupled to the Y electrode Y11 of the first scan group is maintained to be turned on. Also, the transistors Ysch of the selection circuits 610-2 and 610-3 coupled to the Y electrodes Y21 and Y31 of the second and third scan groups are maintained to be turned on, and therefore the voltages of the Y electrodes Y21 and Y31 continue to be maintained at the voltage of VscH.

The transistor Yfr is turned on and the voltage at the Y electrode Y11 is gradually reduced. The transistor Yscl of the selection circuit 610-1 coupled to the Y electrode Y11 of the first scan group is turned off and the transistor Ysch of the selection circuit 610-1 coupled to the Y electrode Y11 of the first scan group is turned on when the voltage at the Y electrode Y11 reaches the final reset voltage Vnf1=VscL. The voltage of VscH is supplied to the Y electrode Y11, and the voltages of the Y electrodes Y21 and Y31 continue to be maintained at the voltage of VscH because the transistors Ysch of the selection circuits 610-2 and 610-3 are turned on.

According to the first exemplary embodiment of the present invention, for the falling reset period, the voltage of VscH is sequentially supplied from the scan group on the lower part of the panel to the scan group on the upper part of the panel by turning on the transistors Ysch coupled to the upper parts of the selection circuits in order to stop supplying the falling reset waveform. Therefore, the final reset voltage of the scan groups are established to be different from one another, and a state of the wall charges at the discharge cells of different scan groups are different from one another.

As shown in FIG. 7, a falling waveform supply 720 according to a second exemplary embodiment of the present invention, in addition to the components of the waveform supply 620 shown in FIG. 6, further includes a zener diode Dnf coupled between the transistor Yfr and the power source for supplying the voltage of VscL, and a transistor Ynf coupled to the zener diode Dnf in parallel. A cathode of the zener diode Dnf is coupled to a source of the transistor Yfr, and an anode of the zener diode Dnf is coupled to the power source for supplying the voltage of VscL. A breakdown voltage Vz of the zener diode Dnf is assumed to be a voltage of (Vnf1−Vnf3) corresponding to a difference between the final reset voltage Vnf1 of the first scan group and the final reset voltage Vnf3 of the third scan group. A voltage at the source of the transistor Yfr substantially corresponds to the voltage of Vnf3 by the zener diode Dnf when the transistor Yfr is turned on and the transistor Ynf is turned off in the early falling period. Accordingly, voltages of the Y electrodes are gradually reduced to the voltage of Vnf3. As described, the voltage of Vnf3 is more stably supplied when the zener diode Dnf is used.

The transistor Ysch of the selection circuit 610-3 coupled to the third scan group is turned on when the voltages of the Y electrodes are reduced to the voltage of Vnf3. Then, the voltage at the Y electrode Y31 is maintained at the voltage of VscH.

The transistors Yfr and Ynf are turned on, the voltages of the Y electrodes Y11 and Y21 are reduced to the voltage of Vnf2, the transistor Yfr is turned off, the transistor Ysch of the selection circuit 610-2 coupled to the second scan group is turned on, and the voltage at the Y electrode Y21 is maintained at the voltage of VscH.

The transistors Yfr and Ynf are turned on, the voltage at the Y electrode Y11 is reduced to the voltage of (Vnf1=VscL), the transistor Yfr is turned off, the transistor Ysch of the selection circuit 610-1 coupled to the first scan group is turned on, and the voltage at the Y electrode Y31 is maintained at the voltage of VscH.

While it has been described that the voltage at the Y electrodes is reduced in a ramp style, the voltage at the Y electrodes may alternatively be gradually reduced by repeatedly reducing the voltage at the Y electrodes by a predetermined amount and floating the Y electrodes for a predetermined period.

That is, the Y electrodes are floated by interrupting the voltage supplied to the Y electrodes for a predetermined period of time after reducing the voltage applied to the Y electrodes by a predetermined amount. The operations of reducing the voltage at the Y electrodes by a predetermined amount and floating the Y electrodes for a predetermined period of time are repeated. A discharge is generated between an X electrode and a Y electrode when a voltage difference between the voltage at the X electrode and the voltage at the Y electrode exceeds a discharge firing voltage while the operation is repeated. When the discharge is generated between the X electrode and the Y electrode and the Y electrode is floated, the voltage at the Y electrode is varied according to an amount of the wall charges because no current inflows from external power. Therefore, the discharge is eliminated by a lesser variation of the wall charges because an internal voltage of the discharge space (discharge cell) is reduced by the variation of the wall charges. The voltage at the floated Y electrode is increased by a predetermined voltage because the X electrode is maintained at a voltage of Ve when the internal voltage of the discharge space is reduced. Intensive discharge extinction is generated in the discharge space because the wall charges formed on the X electrode and the Y electrode are reduced and the internal voltage of the discharge space is rapidly reduced when the discharge is generated by the reduction of the voltage at the Y electrode. When the discharge is generated by reducing the voltage at the Y electrode and the Y electrode is floated, the wall charges are reduced and the intensive discharge extinction is generated in the discharge space in the like manner as the above. A desirable amount of the wall charges is formed on the X electrode and the Y electrode when the voltage at the Y electrode is reduced and the operation to float the Y electrode is repeated for a predetermined number of times.

A circuit and method for supplying the waveforms described above will now be described with reference to FIG. 8 to FIG. 10.

As shown in FIG. 8, a falling waveform supply 820 of the Y electrodes according to a third exemplary embodiment of the present invention supplies a falling waveform to the Y electrodes for the falling reset period, and includes transistors Yfr and Yrc, a capacitor Cd, a resistor R1, a diode D1, and a control signal voltage source Vg. The capacitor Cd, the resistor R1, the diode D1, and the control signal voltage source Vg operate as a driver for driving the transistor Yfr, and the voltage at the Y electrodes is gradually reduced by the operation of the driver.

While the transistors Yfr and Yrc are illustrated as N-channel field effect transistors in FIG. 8, various different switches for performing a function similar to that of the transistors Yfr and Yrc may be used instead of the transistors Yfr and Yrc. A drain which is a main terminal of the transistor Yfr is coupled to each Y electrode which is a first terminal of the panel capacitor Cp, and a source which is another main terminal is coupled to a first terminal of the capacitor Cd. A second terminal of the capacitor Cd is coupled to a power source for supplying a voltage of VscL. The control signal voltage source Vg is coupled between the ground terminal and a gate which is a control terminal of the transistor Yfr, and supplies a control signal Sg to the transistor Yfr.

The diode D1 and the resistor R1 are coupled between the first terminal of the capacitor Cd and the control signal voltage source Vg, and therefore a discharge path for discharging the capacitor Cd is formed. A drain which is a main terminal of the transistor Yrc is coupled to the first terminal of the capacitor Cd and a source which is another main terminal of the transistor Yrc is coupled to the power source for supplying the voltage of VscL which is the second terminal of the capacitor Cd. That is, the transistor Yrc is coupled to the capacitor Cd in parallel.

An operation for the driving circuit shown in FIG. 8 will be described with reference to FIG. 9. It will be assumed that a discharge is not generated in the waveform of FIG. 8 for convenience of description. The waveform of FIG. 8 may be given as a type where a voltage Vp increases in a floating period in the case where the discharge is generated. It is also assumed that the transistor Yrc is turned off.

Figure 9:
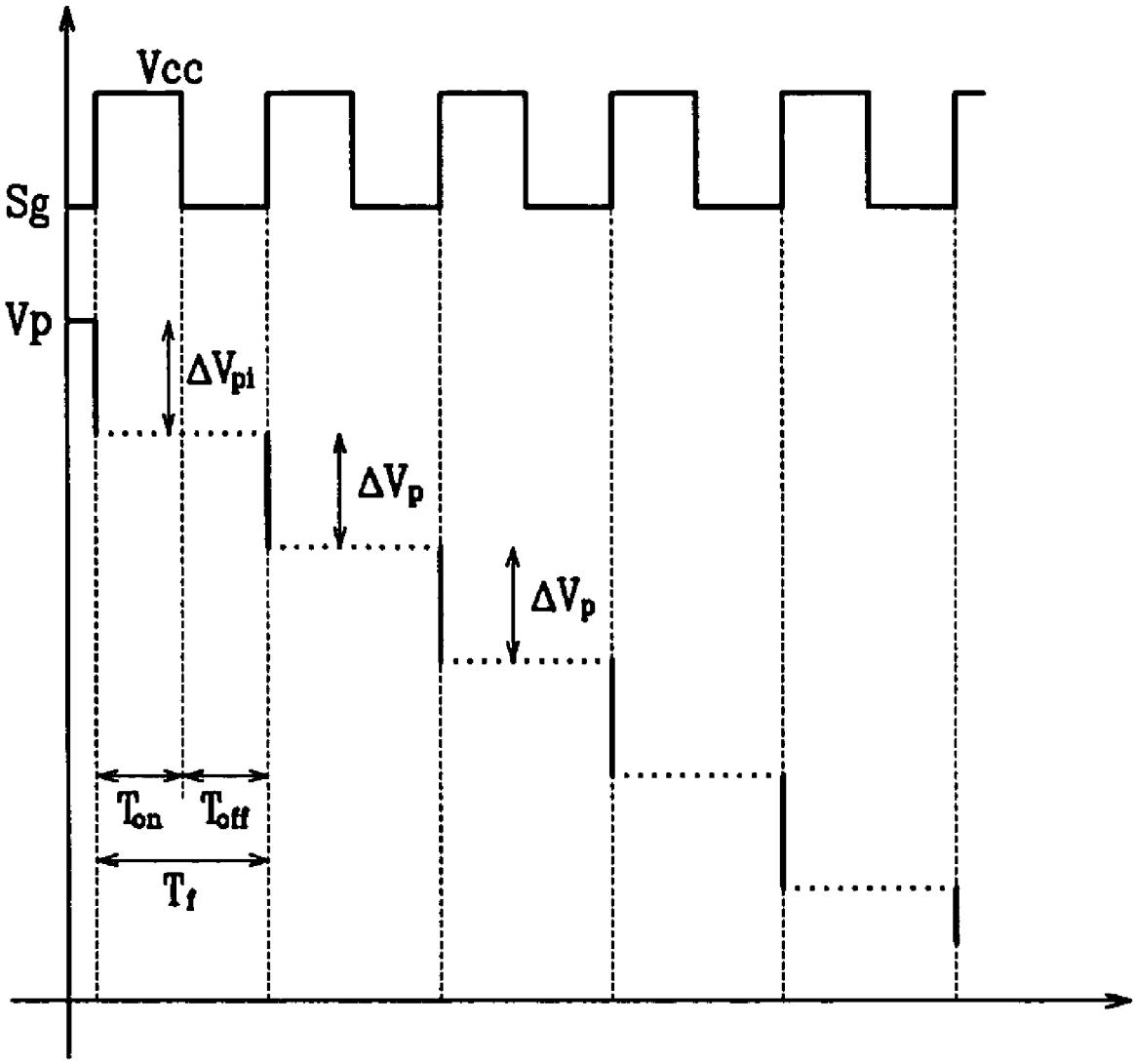
FIG. 9 is a diagram for representing waveforms generated by the driving circuit shown in FIG. 8.

As shown in FIG. 9, the control signal Sg alternately has a high level voltage Vcc for turning on the transistor Yfr and a low level voltage for turning off the transistor Yfr.

Charges accumulated in the panel capacitor Cp are transmitted to the capacitor Cd when the transistor Yfr is turned on by the high level control signal Sg. When the charges are accumulated in the capacitor Cd, the voltage at the first terminal of the capacitor Cd is increased and a source voltage of the transistor Yfr is increased. While a gate voltage of the transistor Yfr is maintained at a voltage for turning on the transistor Yfr, the source voltage at the transistor Yfr is increased with respect to the gate voltage because the voltage at the first terminal of the capacitor Cd is increased with respect to the voltage at the second terminal of the capacitor Cd. Further, when the source voltage of the transistor Yfr is increased to a predetermined voltage, a gate-source voltage of the transistor Yfr becomes less than a threshold voltage Vt of the transistor Yfr and therefore the transistor Yfr is turned off.

That is, the transistor Yfr is turned off when a voltage difference between the high level voltage of the control signal and the source voltage of the transistor Yfr is less than the threshold voltage Vt of the transistor Yfr. The panel capacitor Cp is floated because the voltage supplied to the panel capacitor Cp is interrupted when the transistor Yfr is turned off. At this time, the voltage of the panel capacitor Cp is substantially instantaneously reduced by a predetermined voltage because charge transfer from the panel capacitor Cp to the capacitor Cd is substantially instantaneously performed. That is, floating the panel capacitor Cp by interrupting the voltage is faster than floating the panel capacitor Cp by controlling a level of the control signal. The floating period Tf is longer than a high voltage applying period $T_{on}$ because the transistor Yfr remains turned off when the control signal Sg is at a low level during a low voltage applying period $T_{off}$.

The capacitor Cd is discharged through the path of the capacitor Cd, the diode D1, the resistor R1 and the gate voltage source Vg because the voltage at the first terminal of the capacitor Cd is greater than the voltage of the gate voltage source Vg when the control signal is at a low level.

The transistor Yfr is turned on and the charges are transmitted from the panel capacitor Cp to the capacitor Cd when the control signal is at high level Vcc. The transistor Yfr is initially turned off when charges of ΔQi corresponding to a voltage drop in the panel capacitor Cp of ΔVpi is charged to the capacitor Cd. While the transistor Yfr is turned off, the capacitor Cd is discharged, and the amount of charges in the capacitor Cd decreases by ΔQd such that the amount of charges stored in the capacitor Cd is now (ΔQi−ΔQd). After the transistor Yfr is turned on again, charges from the panel capacitor Cp are once again charged to the capacitor Cd. The transistor Yfr is turned off again when charges of ΔQd are transmitted from the panel capacitor Cp to the capacitor Cd because the transistor Yfr is turned off when charges of ΔQi are accumulated in the capacitor Cd.

The transistor Yfr is turned off because the voltage of the capacitor Cd is increased when the voltage of the panel capacitor Cp is reduced by a voltage of ΔVp shown in FIG. 9. Hence, the voltage drop of ΔVp corresponds to the charges of ΔQd. The capacitor Cd is discharged while the transistor Yfr is turned off when the control signal Sg is at a low level. That is, an operation that the voltage of the panel capacitor Cp is reduced by responding to the high-level control signal Sg and an operation that the panel capacitor Cp is floated according to the voltage increase of the capacitor Cd are repeated. Therefore, a waveform in which a voltage of the Y electrode is reduced and the Y electrode is floated is generated as can be seen in FIG. 9.

An operation of the transistor Yrc in the falling waveform supply 820 in FIG. 8 will be described. In the driving circuit of FIG. 8, when the voltage of the panel capacitor Cp is reduced below a predetermined voltage, the voltage of the capacitor Cd becomes less than a voltage of (Vcc−Vt), where Vcc is the voltage of the control signal Sg at high level and Vt is the threshold voltage of the transistor Yfr, because the charges transmitted from the panel capacitor Cp to the capacitor Cd are reduced. In this case, the floating period can be reduced when the transistor Yfr is not turned off by the voltage of the capacitor Cd. Further, the voltage discharged by the capacitor Cd is also reduced when the voltage charged in the capacitor Cd becomes less than the voltage of (Vcc−Vt). In this case, the amount of charges transmitted from the panel capacitor Cp to the capacitor Cd when the transistor Yfr is turned on, is reduced. As described, with the falling waveform supply 820, it can take a long time for the voltage to be reduced to a desired voltage in the latter part of the falling waveform of FIG. 9 because the amount of voltage reduction is reduced.

When the charges transmitted from the panel capacitor Cp to the capacitor Cd are reduced because the voltage of the panel capacitor Cp is reduced as described above, a signal for turning on the transistor Yrc is applied to a gate, which is a control terminal of the transistor Yrc. The transistor Yrc is turned on and the voltage of the capacitor Cd is discharged to the power source of the voltage VscL through the transistor Yrc. Therefore, the voltage of the panel capacitor Cp is quickly reduced because the transistor Yfr is turned on when the voltage of the capacitor Cd is sufficiently discharged.

A method for supplying the falling waveform to each scan group in the falling reset period will be described.

The transistor Yfr and the transistor Yrc are turned on and the voltages of the Y electrodes Y11, Y21 and Y31 are gradually reduced to the final reset voltage Vnf3 of the third scan group. At this time, the transistors Yscl of the respective selection circuits 610-1, 610-2 and 610-3 are turned on. The transistor Yfr is turned off and the voltages of the Y electrodes are floated when the voltages of the Y electrodes Y11, Y21 and Y31 are reduced to the voltage of Vnf3, the transistor Yscl of the selection circuit 610-3 coupled to the Y electrode Y31 of the third scan group is turned off and the transistor Ysch of the selection circuit 610-3 is turned on after a predetermined time, and the transistor Yfr is turned on. The high peak voltage VscH of the scan pulse is applied to the Y electrode Y31 coupled to the selection circuit 610-3 through the transistor Ysch as shown in FIG. 5. At this time, the voltages of the Y electrodes Y11 and Y21 are gradually reduced from the voltage of Vnf3 because the transistors Yscl of the selection circuits 610-1 and 610-2 coupled to the Y electrodes Y11 and Y21 of the first and second scan groups are turned on. Also, the voltage of the Y electrode Y31 is maintained at the voltage VscH because the transistor Ysch of the selection circuit 610-3 coupled to the Y electrode Y31 of the third scan group is turned on.

The transistor Yfr is turned off and the voltages of the Y electrodes Y11 and Y21 are floated when the voltages of the Y electrodes Y11 and Y21 are reduced to the voltage of Vnf2, the transistor Yscl of the selection circuit 610-2 coupled to the Y electrode Y21 of the second scan group is turned off and the transistor Ysch of the selection circuit 610-2 is turned on after a predetermined time, and the transistor Yfr is turned on. The high peak voltage of VscH of the scan pulse is applied to the Y electrode Y21 coupled to the selection circuit 610-2 through the transistor Ysch as shown in FIG. 5. At this time, the voltage of the Y electrode Y11 is gradually reduced from the voltage of Vnf2 because the transistor Yscl of the selection circuits 610-1 coupled to the Y electrodes Y11 of the first scan group is turned on. Also, the voltages of the Y electrodes Y21 and Y31 continue to be maintained at the voltage of VscH because the transistors Ysch of the selection circuits 610-2 and 610-3 coupled to the Y electrodes Y21 and Y31 of the second and third scan groups are turned on.

The transistor Yfr is turned on and the voltage of the Y electrode Y11 is gradually reduced. The transistor Yscl of the selection circuit 610-1 coupled to the Y electrode Y11 of the first scan group is turned off and the transistor Ysch of the selection group 610-1 is turned on when the voltage of the Y electrode Y11 reaches the final reset voltage (Vnf1=VscL) of the first scan group. The voltage of VscH is supplied to the Y electrode Y11, and the voltages of the Y electrodes Y21 and Y31 continue to be maintained at the voltage of VscH because the transistors Ysch of the selection circuits 610-2 and 610-3 are turned on.

While the final falling reset voltage of Vnf1 of the first scan group is substantially the same as the low peak voltage of VscL of the scan pulse in the third exemplary embodiment of the present invention as described above, the final falling reset voltage of Vnf1 of the first scan group may be established to be different from the low peak voltage VscL of the scan pulse.

Figure 10:
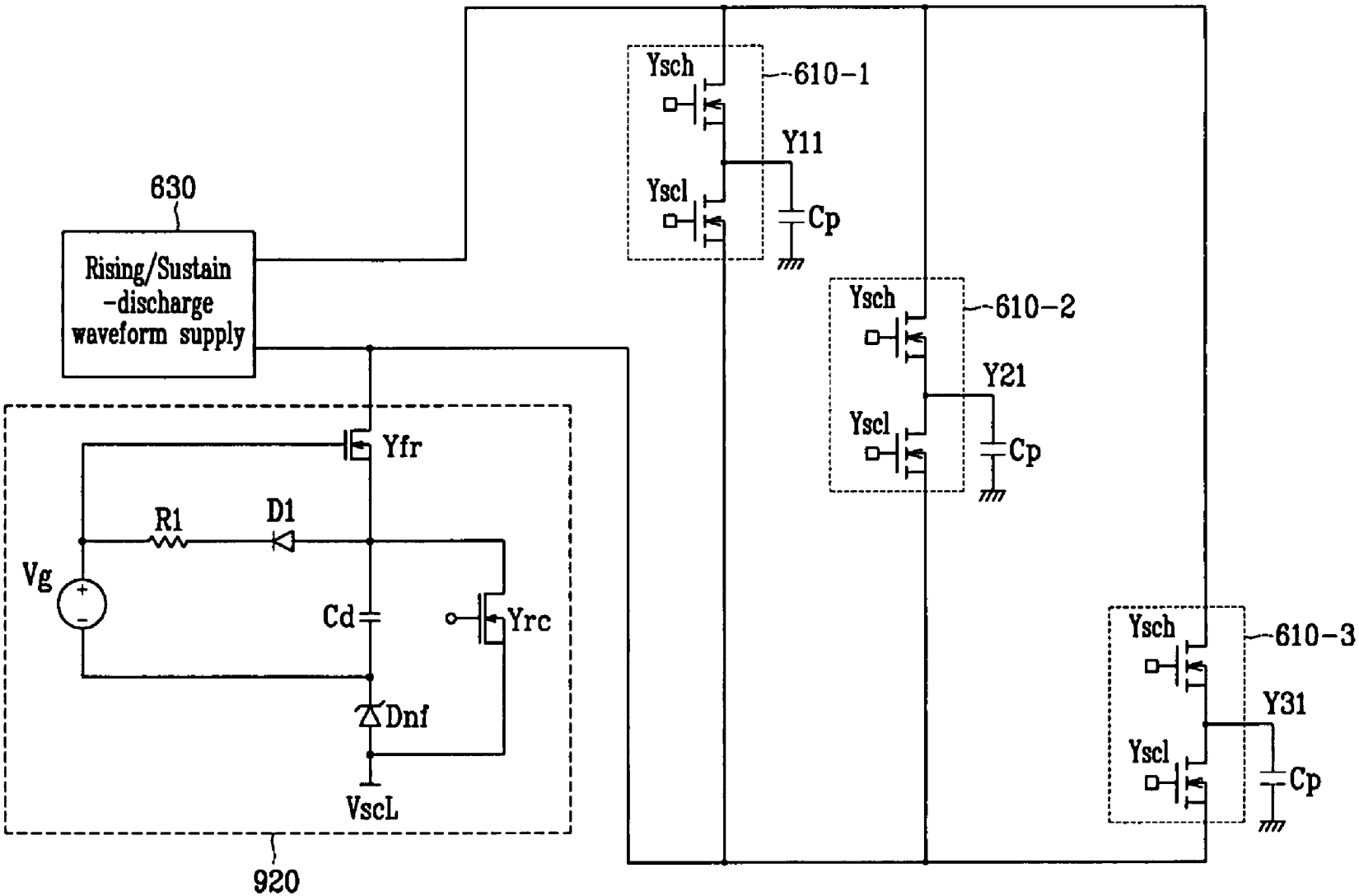
FIG. 10 is a schematic diagram of a Y electrode driver according to a fourth exemplary embodiment of the present invention.
Figure 11:
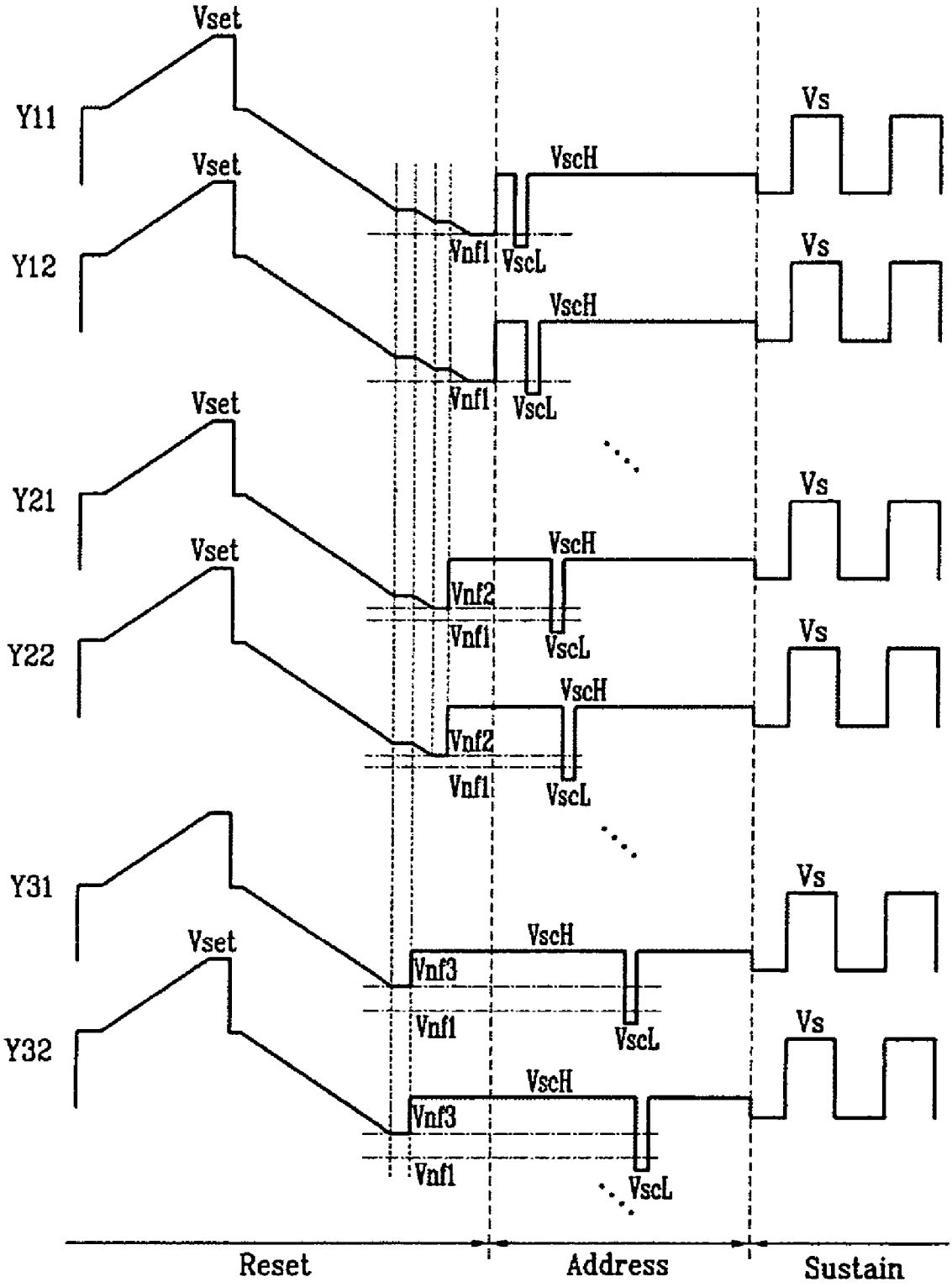
FIG. 11 shows a diagram for representing waveforms generated by the driving circuit shown in FIG. 10.

FIG. 10 is a schematic diagram of a Y electrode driver according to a fourth exemplary embodiment of the present invention, and FIG. 11 shows waveforms supplied to the Y electrodes by the circuit shown in FIG. 10.

As shown in FIG. 10, a falling waveform supply 920 according to the fourth exemplary embodiment of the present invention further includes a zener diode Dnf in addition to the components of the falling waveform supply 820 shown in FIG. 8. A second terminal of the capacitor Cd is coupled to a cathode of the zener diode Dnf, and an anode of the zener diode Dnf is coupled to a power source for supplying the voltage of VscL. A breakdown voltage Vz of the zener diode Dnf is a voltage of (Vnf3−VscL) corresponding to a difference between the final reset voltage of Vnf3 of the third scan group and the low peak voltage of the scan pulse.

In the circuit as shown in FIG. 10, the transistor Yrc is turned off for the falling reset period, and the falling reset waveform is applied to the Y electrodes by an operation corresponding to the second exemplary embodiment of the present invention.

The transistor Yrc is turned on when the voltage of the Y electrode Y11 reaches the final reset voltage of Vnf1 of the first scan group and the falling reset period is finished. The voltage of VscL, which is less than the voltage of Vnf1, is applied to the Y electrodes as the scan pulse as shown in FIG. 11 through a path formed by the transistor Yfr to the transistor Yrc.

While the final reset voltage is varied by using a voltage of VscL and a transistor Yfr in the first to fourth exemplary embodiments of the present invention, additional power source may be used per group to supply the final reset voltage to each group.

According to the present invention, the Y electrodes are divided into a plurality of groups according to a scanning order, the final reset voltage for each group is established to be varied, the state of the wall charges is established to be substantially the same as each other when each group is addressed in the address period, and therefore the address discharge efficiency is increased.

While certain exemplary embodiments of the present invention have been described above, it will be apparent to those skilled in the art that various modifications and variations can be made to the described embodiments without departing from the spirit or scope of the invention. Thus, it is intended that the present invention cover the modifications and variations of this invention that are within the scope of the appended claims and their equivalents.

What is claimed is:

1. A method for driving a plasma display panel including a plurality of first electrodes and a plurality of second electrodes, the first electrodes being divided into a plurality of groups comprising a first group and a second group, the method comprising:

in a reset period, a) gradually reducing a voltage at the first electrodes to a first voltage;

b) applying a second voltage, which is greater than the first voltage, to the first electrodes of the first group;

c) gradually reducing the voltage at the first electrodes of the groups other than the first group to a third voltage, which is less than the first voltage, while maintaining the first group of the first electrodes at the second voltage; and d) applying a fourth voltage, which is greater than the third voltage, to the first electrodes of the second group.

2. The method of claim 1, further comprising:

in an address period, sequentially applying scan pulses to the first electrodes of the first group while the voltage at the first electrodes of the first group is maintained at the second voltage; and sequentially applying the scan pulses to the first electrodes of the second group while the voltage at the first electrodes of the second group is maintained at the fourth voltage.

3. The method of claim 1, wherein the fourth voltage is substantially the same as the second voltage.

4. A method for driving a plasma display panel including a plurality of first electrodes and a plurality of second electrodes, the first electrodes being divided into a plurality of groups comprising a first group, a second group and a third group, the method comprising:

in a reset period, a) gradually reducing a voltage at the first electrodes to a first voltage;

b) applying a second voltage, which is greater than the first voltage, to the first electrodes of the first group;

c) gradually reducing the voltage at the first electrodes of the groups other than the first group to a third voltage, which is less than the first voltage; and d) applying a fourth voltage, which is greater than the third voltage, to the first electrodes of the second group;

e) gradually reducing the voltage at the first electrodes of the groups other than the first and second groups to a fifth voltage, which is less than the third voltage; and f) applying a sixth voltage, which is greater than the fifth voltage, to the first electrodes of the third group.

5. The method of claim 1, wherein the voltage at the first electrodes is reduced in a ramp style.

6. The method of claim 1, wherein the voltage at the first electrodes is gradually reduced by repeatedly reducing the voltage at the first electrodes by a step amount and then floating the first electrodes.

7. A method for driving a plasma display panel including a plurality of first electrodes and a plurality of second electrodes, the method comprising:

in a reset period, gradually reducing a voltage at the first electrodes;

applying a non-scan voltage to the first electrodes of a first group among the plurality of first electrodes while the voltage at the first electrodes other than the first electrodes of the first group is reduced; and applying the non-scan voltage to the first electrodes of a second group among the plurality of first electrodes after the voltage at the first electrodes of the second group is reduced to a final reset voltage.

8. The method of claim 7, further comprising, in an address period, sequentially applying a scan voltage to the plurality of first electrodes.

9. The method of claim 8, wherein the scan voltage is substantially the same as the final reset voltage.

10. The method of claim 8, wherein the scan voltage is lower than the final reset voltage.

11. A plasma display panel comprising:

a panel including a plurality of first electrodes and a plurality of second electrodes;

a plurality of selection circuits, each selection circuit coupled to a corresponding one of the first electrodes and having a first terminal and a second terminal, wherein each selection circuit is configured to selectively apply a voltage supplied to the first terminal or a voltage supplied to the second terminal to the corresponding one of the first electrodes; and a driving circuit coupled to the second terminals of the selection circuits, wherein the driving circuit is configured to gradually reduce a voltage at the first electrodes in a reset period, and apply a scan voltage to the first electrodes through the second terminals of the selection circuits in an address period, wherein a non-scan voltage is applied to the first electrodes of a first group among the plurality of first electrodes through the first terminals of the selection circuits coupled to the first electrodes of the first group after the voltage at the first electrodes is reduced to a first voltage in the reset period, while the voltage applied to a second group among the plurality of first electrodes approaches a second voltage, and wherein the non-scan voltage is applied to the first electrodes of the second group among the plurality of first electrodes through the first terminals of the selection circuits coupled to the first electrodes of the second group when the voltage at the first electrodes of the second group is reduced to the second voltage, which is lower than the first voltage, in the reset period.

12. The plasma display panel of claim 11, wherein the driving circuit comprises a transistor having a first terminal coupled to the second terminals of the selection circuits, and a second terminal coupled to a power source for supplying the scan voltage, and the transistor allows the voltage at the first electrodes to be reduced in a ramp style in the reset period.

13. The plasma display panel of claim 12, wherein the driving circuit further comprises:

a zener diode having a cathode coupled to the second terminal of the transistor and an anode coupled to the power source; and a switch coupled to the zener diode in parallel.

14. The plasma display panel of claim 13, wherein a breakdown voltage of the zener diode is substantially the same as a difference between the first voltage and the second voltage.

15. The plasma display panel of claim 13, wherein the driving circuit controls the switch to be turned off to reduce the voltage at the first electrodes to the first voltage, and controls the switch to be turned off to reduce the voltage at the first electrodes to the second voltage.

16. The plasma display panel of claim 11, wherein the driving circuit comprises:

a first transistor having a first terminal coupled to the second terminals of the selection circuits, and a control terminal for receiving a control signal which alternately has a first level for turning on the first transistor and a second level which is an inverted level of the first level;

a capacitor having a first terminal coupled to a second terminal of the first transistor and a second terminal coupled to a power source for supplying the scan voltage, wherein the capacitor receives charges from the first electrodes when the first transistor is turned on; and a discharge path for discharging the charges charged in the capacitor in response to the second level of the control signal.

17. The plasma display panel of claim 16, wherein the driving circuit further comprises a second transistor which is coupled to the capacitor in parallel.

18. The plasma display panel of claim 17, wherein the charges charged in the capacitor are discharged through the second transistor when the second transistor is turned on.

19. The plasma display panel of claim 17, wherein the driving circuit further comprises a zener diode having a cathode coupled to the second terminal of the capacitor and an anode coupled to the power source.

20. The plasma display panel of claim 19, wherein the driving circuit controls the second transistor to be turned off to reduce the voltage at the first electrodes to a voltage which is greater than the scan voltage by a breakdown voltage of the zener diode in the reset period, and controls the second transistor to be turned on to apply the scan voltage to the first electrodes.

* * * * *